US010669896B2

(12) United States Patent
Propheter-Hinckley et al.

(10) Patent No.: US 10,669,896 B2
(45) Date of Patent: Jun. 2, 2020

(54) DIRT SEPARATOR FOR INTERNALLY COOLED COMPONENTS

(71) Applicant: United Technologies Corporation, Farmington, CT (US)

(72) Inventors: Tracy A. Propheter-Hinckley, Rocky Hill, CT (US); Joel H. Wagner, Wethersfield, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 186 days.

(21) Appl. No.: 15/873,475

(22) Filed: Jan. 17, 2018

(65) Prior Publication Data

US 2019/0218940 A1 Jul. 18, 2019

(51) Int. Cl.
*F01D 25/32* (2006.01)
*F01D 5/18* (2006.01)

(52) U.S. Cl.
CPC ..... *F01D 25/32* (2013.01); *F01D 5/187* (2013.01); *F05D 2220/32* (2013.01); *F05D 2240/305* (2013.01); *F05D 2240/307* (2013.01); *F05D 2250/185* (2013.01); *F05D 2250/231* (2013.01); *F05D 2260/201* (2013.01); *F05D 2260/202* (2013.01); *F05D 2260/607* (2013.01)

(58) Field of Classification Search
CPC ..... F01D 25/32; F01D 5/186; F01D 5/187; B01D 45/04; B01D 45/08; B01D 45/12; B01D 45/14; B01D 45/16; F05D 2260/607
See application file for complete search history.

(56) References Cited

U.S. PATENT DOCUMENTS 4,177,010 A * 12/1979 Greaves ..... F01D 5/187 416/96 A
4,775,296 A 10/1988 Schwarzmann et al.
4,820,122 A 4/1989 Hall et al.
5,419,039 A * 5/1995 Auxier ..... B23P 15/04 29/889.7
5,498,126 A 3/1996 Pighetti et al.
(Continued)

FOREIGN PATENT DOCUMENTS

DE 10236676 A1 * 2/2004 ..... F01D 5/186
GB 2262314 A 6/1993

OTHER PUBLICATIONS

EP search report for EP19152334.9 dated Apr. 16, 2019.

*Primary Examiner* — Moshe Wilensky
*Assistant Examiner* — Topaz L. Elliott
(74) *Attorney, Agent, or Firm* — Getz Balich LLC

(57) ABSTRACT

A gas turbine engine internally cooled component airfoil includes a peripheral wall and a cooling system. The peripheral wall has an external surface including a suction surface and a pressure surface laterally spaced from the suction surface. The cooling system includes at least one or more passages bounded in part by the peripheral wall. At least a first of the one or more passages includes a first passage pressure side surface that includes an interior protrusion including a first sloped surface extending to a peak of the interior protrusion and a second sloped surface extending from the peak substantially in the direction of the pressure side surface. The slope of the second sloped surface is greater than the slope of the first sloped surface and a first cooling hole extends from the second sloped surface through the interior protrusion.

16 Claims, 6 Drawing Sheets

(56) References Cited

U.S. PATENT DOCUMENTS

| | | | | |
|---|---|---|---|---|
| 5,827,043 | A | 10/1998 | Fukuda et al. | |
| 6,547,524 | B2 * | 4/2003 | Kohli | F01D 5/141 415/115 |
| 7,128,533 | B2 * | 10/2006 | Liang | F01D 5/186 416/97 R |
| 7,293,962 | B2 * | 11/2007 | Fried | F01D 5/187 415/115 |
| 7,695,243 | B2 * | 4/2010 | Lee | F01D 5/188 415/115 |
| 8,961,111 | B2 | 2/2015 | Benson et al. | |
| 9,376,919 | B2 * | 6/2016 | Fujimoto | F01D 5/186 |
| 9,963,982 | B2 * | 5/2018 | Zelesky | F01D 5/186 |
| 2002/0172596 | A1 | 11/2002 | Kohli et al. | |
| 2016/0069198 | A1 * | 3/2016 | Zelesky | F01D 5/186 415/116 |
| 2016/0177738 | A1 | 6/2016 | Moore et al. | |
| 2016/0375610 | A1 | 12/2016 | Vollebregt et al. | |
| 2017/0306764 | A1 * | 10/2017 | Konitzer | F01D 5/186 |
| 2019/0078472 | A1 * | 3/2019 | Tan | F01D 25/32 |

* cited by examiner

DIRT SEPARATOR FOR INTERNALLY COOLED COMPONENTS

BACKGROUND OF THE INVENTION

1. Technical Field

The present disclosure relates to internally cooled turbomachinery components and, more particularly to an internally cooled airfoil for a gas turbine engine where the airfoil includes a dirt filtering system within the airfoil.

2. Background Information

The blades and vanes used in the turbine section of a gas turbine engine each have an airfoil section that extends radially across an engine flowpath. During engine operation the turbine blades and vanes are exposed to elevated temperatures that can lead to mechanical failure and corrosion. Therefore, it is common practice to make the blades and vanes from a temperature tolerant alloy and to apply corrosion resistant and thermally insulating coatings to the airfoil and other flowpath exposed surfaces. It is also widespread practice to cool the airfoils by flowing a coolant through the interior of the airfoils.

One well known type of airfoil internal cooling arrangement employs cooling circuits. A leading edge circuit can include a radially extending impingement cavity connected to a feed channel by a series of radially distributed impingement holes. An array of "showerhead" and/or "gill row" holes can extend from the impingement cavity to the airfoil surface in the vicinity of the airfoil leading edge. Coolant flows radially outward through the feed channel to convectively cool the airfoil, and a portion of the coolant flows through the impingement holes and impinges against the forward most surface of the impingement cavity. The coolant then flows through the holes and discharges over the leading edge of the airfoil to form a thermally protective film. A midehord cooling circuit(s) can be a radially feed cavity or can be comprised of serpentine passages having two or more chordwisely adjacent legs interconnected by an elbow at the radially innermost or radially outermost extremities of the legs. A series of judiciously oriented cooling holes is distributed along the length of the serpentine, each hole extending from the serpentine to the airfoil external surface. Coolant flows through the serpentine to convectively cool the airfoil and discharges through the cooling holes to provide film cooling. The hole orientation forms a thermally protective film over the airfoil surface. Coolant may also be discharged from the serpentine through an aperture at the blade tip and through a chordwise extending tip passage that guides the coolant out the airfoil trailing edge. A trailing edge cooling circuit includes a radially extending feed passage, an optional one or two radially extended ribs, and a series of radially distributed pedestals. Coolant flows radially into the feed passage and then chordwisely through apertures in the optional ribs and through slots between the pedestals to convectively cool the trailing edge region of the airfoil.

Each of the above described internal passages—the leading edge feed channel, midchord serpentine passage, tip passage and trailing edge feed passage—usually includes a series of turbulence generators referred to as trip strips. The trip strips extend laterally into each passage, are distributed along the length of the passage, and typically have a height only a fraction of a local characteristic dimension of the passage. Turbulence induced by the trip strips enhances convective heat transfer into the coolant.

Turbine cooling holes are general limited to a minimum diameter because of the expected size of dirt particles in the turbine cooling air. This minimum size is selected because any hole smaller than this minimum diameter will experience unacceptable dirt plugging, which will result in reduced part life.

Thus, there is a need for an internally cooled airfoil that includes a dirt removal system.

SUMMARY OF THE DISCLOSURE

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

Aspects of the disclosure are directed to a gas turbine engine internally cooled component airfoil. The gas turbine engine internally cooled component airfoil may comprise a peripheral wall having an external surface comprising a suction surface and a pressure surface laterally spaced from the suction surface, the surfaces extending chordwisely from a leading edge to a trailing edge and radially from a proximate end to a distal end. The gas turbine engine internally cooled component airfoil may also comprise a cooling system comprising at least one or more passages bounded in part by the peripheral wall, where at least a first of the one or more passages includes a first passage pressure side surface that includes an interior protrusion comprising a first sloped surface extending to a peak of the interior protrusion and a second sloped surface extending from the peak substantially in the direction of the pressure side surface. The slope of the second sloped surface may be greater than the slope of the first sloped surface and a first cooling hole extends from the second sloped surface through the interior protrusion to vent the first of the one or more passages to the pressure side surface.

The first and second sloped surfaces may intersect to form a rounded edge.

The slope of the first sloped surface and slope of the second sloped surface may be selected so dirt particles within the first passage are routed away from the first cooling hole.

The gas turbine engine internally cooled component may further comprise a debris passage in a radial tip of the internally cooled airfoil and in fluid communication with the first passage to allow debris to pass from the first passage through the debris passage.

The first cooling hole may have a cylindrical cross section, the proximate end is adjacent to air airfoil root and the distal end is adjacent to an airfoil tip.

The interior protrusion may have a substantially a bulbous shape.

At least one or more passages may comprise a first passage and a second passage that are chordwisely adjacent and radially extending.

The first and second passages may be interconnected to form a cooling serpentine.

According to another aspect of the present disclosure a gas turbine engine internally cooled airfoil is provided. The gas turbine engine internally cooled airfoil may comprise a peripheral wall having an external surface comprising a suction surface and a pressure surface laterally spaced from the suction surface, the surfaces extending chordwisely from a leading edge to a trailing edge and radially from an airfoil root to an airfoil tip. The gas turbine engine internally, cooled airfoil may also comprise a cooling system comprising at least two passages bounded in part by the peripheral wall, chordwisely adjacent and radially extending from the airfoil root to the airfoil tip. Each of the at least two passages may include a first passage pressure side surface that includes an interior air/dirt separating protrusion comprising a first sloped surface extending to a peak of the interior air/dirt separating protrusion and a second sloped surface extending from the peak substantially in the direction of the pressure side surface. The slope of the second sloped surface may be greater than the slope of the first sloped surface and a first cooling hole extends from the second sloped surface through the air/dirt separating interior protrusion to vent the first passage to the pressure side surface. The gas turbine engine internally cooled airfoil may further comprise an airfoil tip surface that substantially seals each of the least two passages at a tip region of the airfoil, where the airfoil tip surface comprises a radial extending debris hole that allows debris particles to exit the airfoil from each of the least two passages.

The first and second sloped surfaces may intersect to form a rounded edge and slope of the first sloped surface and slope of the second sloped surface are selected so dirt particles within the first passage are routed away from the first cooling hole.

The first cooling hole may have a cylindrical cross section and the radial extending debris hole may also have a cylindrical cross section.

The interior protrusion may have substantially a bulbous shape.

The first and second passages may be interconnected to form a cooling serpentine.

According to another aspect of the present disclosure a gas turbine engine internally cooled component is provided. The gas turbine engine internally cooled component may comprise a peripheral wall having an external surface comprising a suction surface and a pressure surface laterally spaced from the suction surface, the surfaces extending chordwisely from a leading edge to a trailing edge and radially from an airfoil root to an airfoil tip. The gas turbine engine internally cooled component may also comprise a cooling system comprising at least two passages bounded in part by the peripheral wall, where at least a first of the two passages includes a first passage pressure side surface that includes an interior protrusion comprising a first sloped surface extending to a peak of the interior protrusion and a second sloped surface extending from the peak substantially in the direction of the pressure side surface. The slope of the second sloped surface may be greater than the slope of the first sloped surface and a first cooling hole extends from the second sloped surface through the interior protrusion to vent the first of the two passages to the pressure side surface.

The first and second sloped surfaces may intersect to form a rounded edge, and slope of the first sloped surface and slope of the second sloped surface are selected so dirt particles within the first medial passage are routed away from the first cooling hole.

The gas turbine engine internally cooled component may further comprise a debris passage in a radial tip of the internally cooled airfoil and in fluid communication with the first passage to allow debris to pass from the first passage through the debris passage.

The first cooling hole may have a cylindrical cross section.

The interior protrusion may have substantially a bulbous shape.

The at least two passages may be chordwisely adjacent and radially extending.

The at least two passages may be interconnected to form a cooling serpentine.

DETAILED DESCRIPTION

Figure 1:
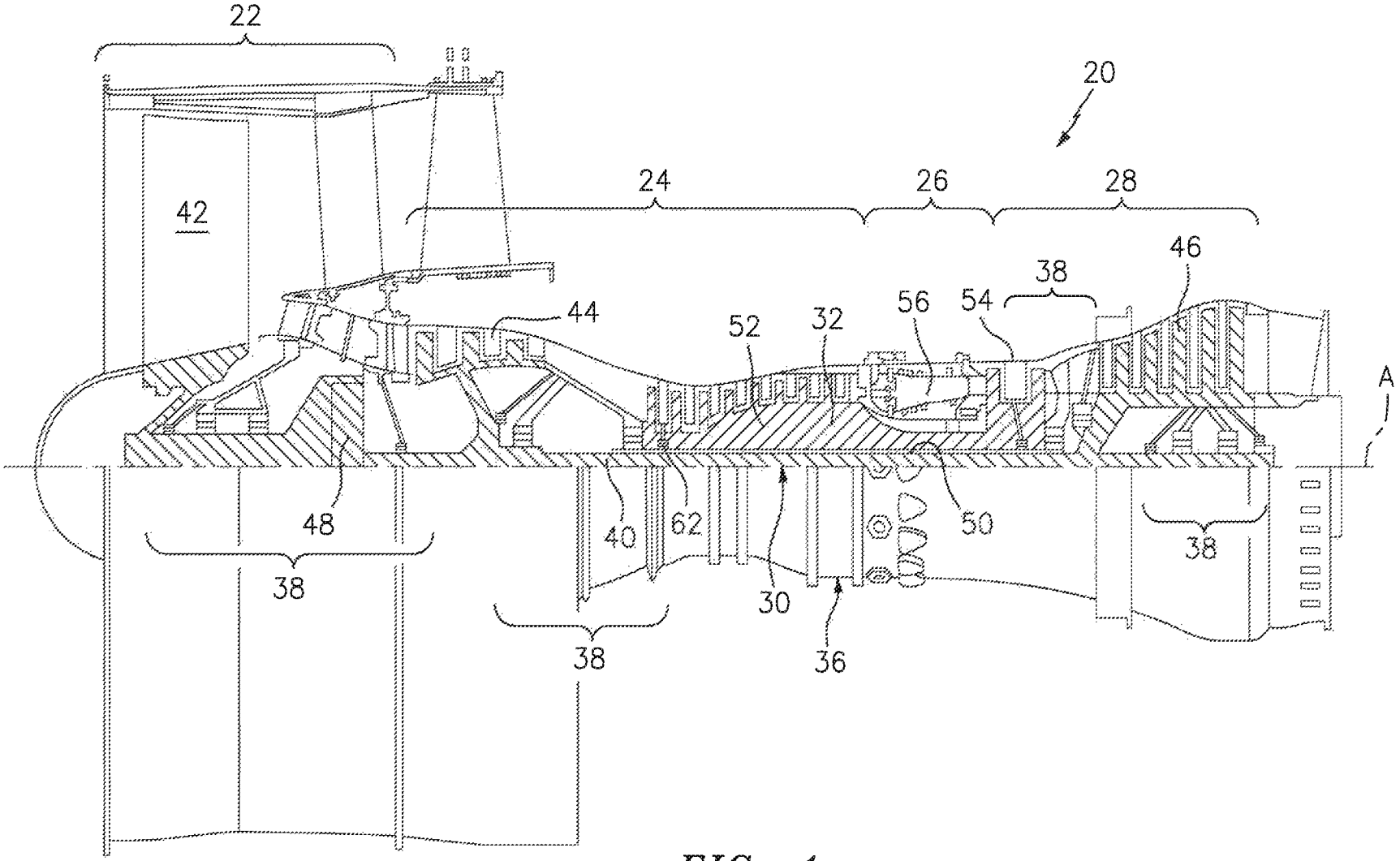
FIG. 1 schematically illustrates a turbofan engine.

It is noted that various connections are set forth between elements in the following description and in the drawings (the contents of which are incorporated in this specification by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities or a space/gap between the entities that are being coupled to one another.

Aspects of the disclosure may be applied in connection with a gas turbine engine.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engines (not shown) might include an auginentor section among other systems or features. Although depicted as a high-bypass turbofan in the disclosed non-limiting embodiment, it should be appreciated that the concepts described herein are not limited to use only with turbofan architectures as the teachings may be applied to other types of turbine engines such as turbojets, turboshafts, industrial gas turbines, and three-spool (plus fan) turbofans with an intermediate spool.

The engine 20 generally includes a low spool 30 and a high spool 32 mounted for rotation about an engine central longitudinal axis A relative to an engine case structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 may drive the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and a high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the LPC 44 then the HPC 52, mixed with the fuel and burned in the combustor 56, then expanded over the HPT 54 and the LPT 46. The LPT 46 and the HPT 54 rotationally drive the respective low spool 30 and high spool 32 in response to the expansion.

Figure 2:
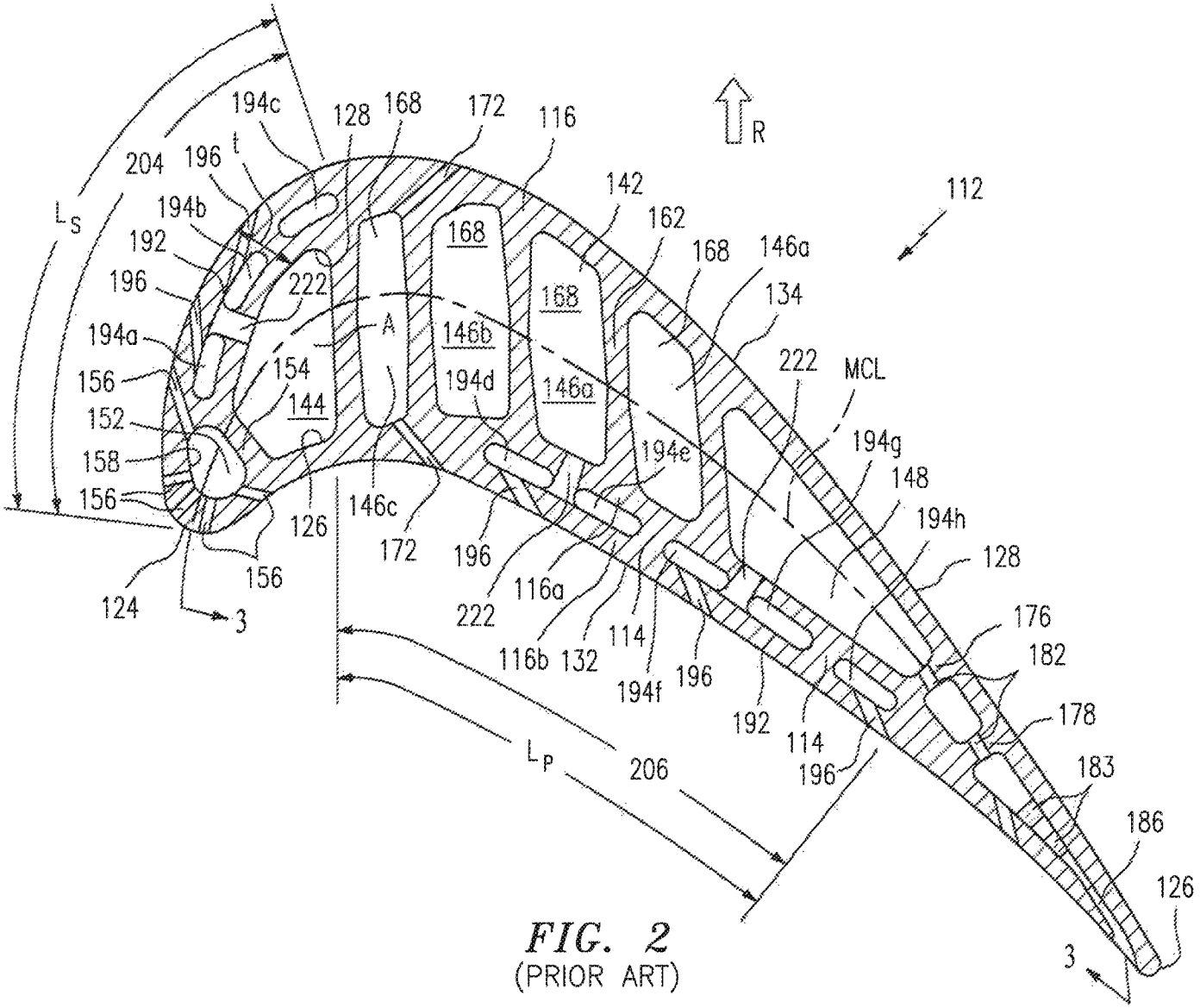
FIG. 2 (PRIOR ART)
FIG. 2 is a cross sectional view of a prior art internally cooled airfoil.
Figure 3:
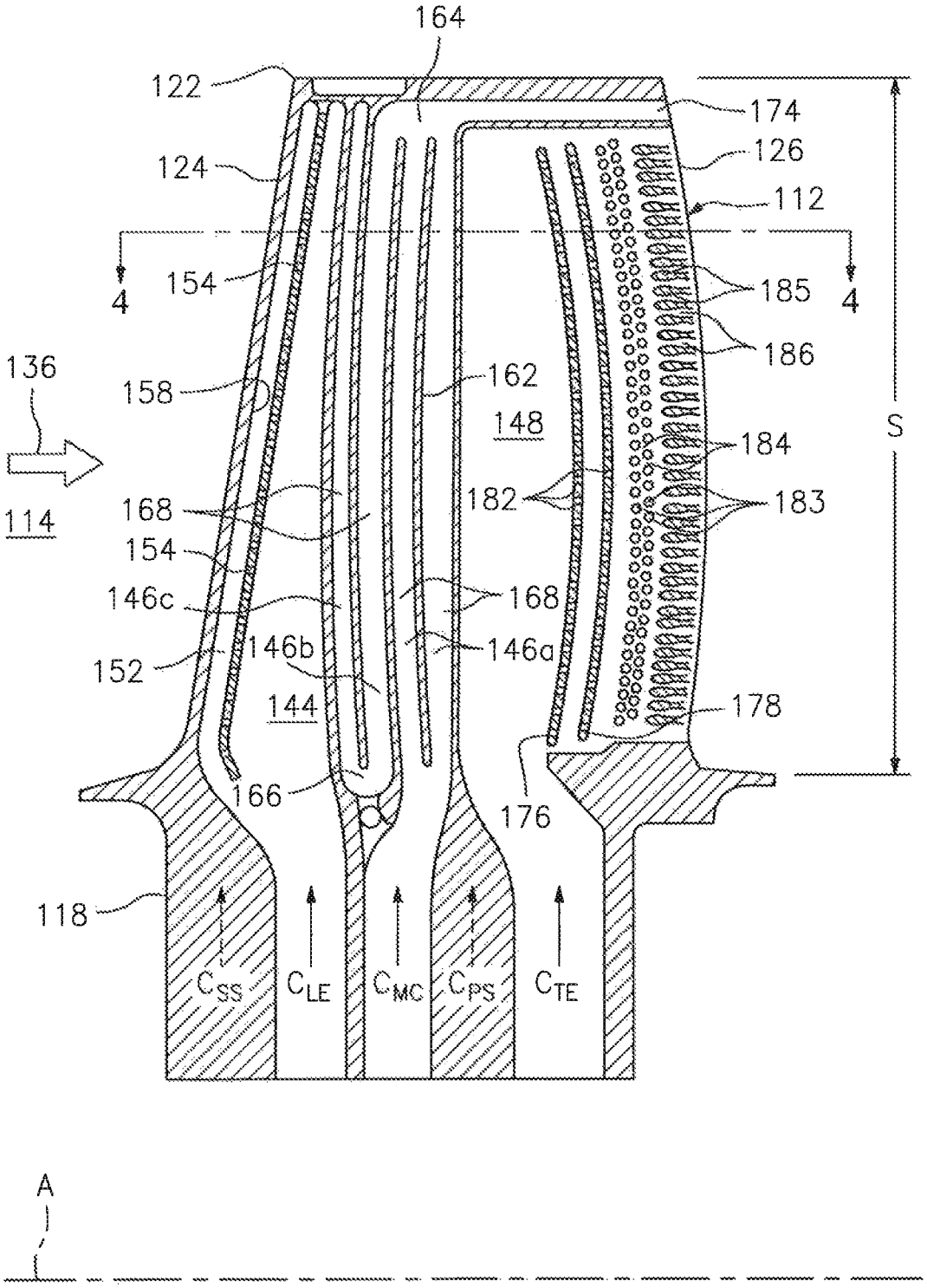
FIG. 3 (PRIOR ART)
FIG. 3 is a view taken substantially in the direction 3-3 of FIG. 2 showing a series of internal coolant passages that comprise a cooling system.

FIG. 2 is a cross sectional view of a prior art internally cooled airfoil 112. FIG. 3 is a view taken substantially in the direction 3-3 of FIG. 2 showing a series of coolant passages (e.g., medial) that comprise a primary cooling system. Referring to FIGS. 2 and 3, an airfoil section that extends radially across an engine flowpath 114. A peripheral wall 116 extends radially from a root 118 to tip 122 of the airfoil 112 and chordwisely from a leading edge 124 to a trailing edge 126. The peripheral wall 116 has an external surface 128 that includes a concave or pressure surface 132 and a convex or suction surface 134 laterally spaced from the pressure surface. A mean camber line MCL extends chordwisely from the leading edge trailing edge midway between the pressure and suction surfaces.

The illustrated blade is one of numerous blades that project radially outwardly from a rotatable turbine hub (not shown). During engine operation, hot combustion gases originating in the engine's combustion chamber flowpath through the flowpath causing the blades and hub to rotate in direction R about an engine longitudinal axis A. The temperature of these gases is spatially nonuniform, therefore the airfoil 112 is subjected to a nonuniform temperature distribution over its external surface 128. In addition, the depth of the aerodynamic boundary layer that envelops the external surface varies in the chordwise direction. Since both the temperature distribution and the boundary layer depth influence the rate of heat transfer from the hot gases into the blade, the peripheral wall is exposed to a chordwisely varying heat load along both the pressure and suction surfaces. In particular, zones of high heat load are present along the chord wise distance from the leading edge to the trailing edge along the suction and pressure surfaces. Although the average temperature of the combustion gases may be well within the operational capability of the airfoil, the heat transfer into the blade in the high heat load zones can cause localized mechanical distress and accelerated oxidation and corrosion.

The blade has a primary cooling system 142 comprising one or more radially extending passages 144, 146*a*, 146*b*, 146*c* and 148 bounded at least in part by the peripheral wall 116. Near the leading edge of the airfoil, feed passage 144 is in communication with impingement cavity 152 through a series of radially distributed impingement holes 154. An array of "showerhead" holes 156 extends from the impingement cavity to the airfoil surface 128 in the vicinity of the airfoil leading edge. Coolant $C_{LE}$ flows radially outwardly through the feed passage 144 and then through the impingement holes 154 and impinges against forward most surface 158 of the impingement cavity to impingement cool the surface 158. The coolant then flows through the showerhead holes and discharges as a thermally protective film over the leading edge of the airfoil.

Midchord passages 146*a*, 146*b* and 146*c* cool the midchord region of the airfoil. The passage 146*a*, which is bifurcated by a radially extending rib 162, and chordwisely adjacent passage 146*b* are interconnected by an elbow 164 at their radially outermost extremities. The chordwisely adjacent passages 146*b* and 146*c* are similarly interconnected at their radially innermost extremities by elbow 166 (FIG. 3). Thus, each of the passages 146*a*, 146*b* and 146*c* is a leg of a serpentine passage 168. Judiciously oriented cooling holes 172 are distributed along the length of the serpentine, each hole extending from the serpentine to the airfoil external surface. Coolant $C_{MC}$ flows through the serpentine to convectively cool the airfoil and discharges through the cooling holes to film cool the airfoil. The discharged coolant also forms a thermally protective film over the pressure and suction surfaces 132, 134. A portion of the coolant that reaches the outermost extremity of the passage 146*a* is discharged through a chordwisely extending tip passage 174 that guides the coolant out the airfoil trailing edge.

The trailing edge feed passage 148 is chordwisely bounded by trailing edge cooling features including ribs 176, 178, each perforated by a series of apertures 182, a matrix of posts 183 separated by spaces 184, and an array of teardrops 185 defining a series of slots 186. Coolant $C_{TE}$ flows radially into the feed passage and chordwisely through the apertures, spaces and slots to convectively cool the trailing edge region.

The airfoil 112 may also include an auxiliary cooling system 192 that includes one or more radially continuous conduits, 194*a*-194*h* (collectively designated 194), substantially parallel to and radially coextensive with the internal coolant passages. Each conduit includes a series of radially spaced film cooling holes 196. The conduits are disposed in the peripheral wall 116 laterally between the internal passages and the airfoil external surface 128, and are chordwisely situated within the zone of high heat load, i.e., within the sub-zones 204, 206 extending respectively from the leading edge to the trailing edge along the pressure and suction surfaces, 132 and 134. Coolant $C_{PS}$, $C_{SS}$ flows through the conduits, thereby, promoting more heat transfer from the peripheral wall than would be possible with the internal passages alone. A portion of the coolant discharges into the flowpath by way of the film cooling holes 196 to film cool the airfoil and establish a thermally protective film along the external surface 128.

The conduits 194 are substantially chordwisely coextensive with at least one of the internal passages so that coolant $C_{PS}$ and $C_{SS}$ absorbs heat from the peripheral wall 116 thereby thermally shielding or insulating the coolant in the chordwisely coextensive internal passages. In the illustrated embodiment, the conduits 194*d*-194*h* along the pressure surface 132 are chordwisely coextensive with both the trailing edge feed passage 148 and with the legs 146*a* and 146*b* of the serpentine passage 168. The chordwise coextensivity between the conduits and the trailing edge feed passage helps to reduce heat transfer into coolant $C_{TE}$ in the feed passage 148. This, in turn, preserves the heat absorption capacity of coolant $C_{TE}$ thereby enhancing its ability to convectively cool the trailing edge region as it flows through the apertures 182, spaces 184 and slots 186. Similarly, the chordwise coextensivity between the conduits and the legs 146*a*, 146*b* of the serpentine passage 168 helps to reduce/minimize the temperature rise of coolant $C_{MC}$ during the coolant's lengthy residence time in the serpentine passage. As a result, coolant $C_{MC}$ retains its effectiveness as a heat transfer medium and is better able to cool the airfoil as it flows through the serpentine leg 146*c* and the tip passage 174. Consequently, the benefits of lengthy coolant residence time are not offset by excessive coolant temperature rise as the coolant progresses through the serpentine.

The auxiliary conduits are chordwisely distributed over substantially the entire length, $L_S+L_P$, of the high heat load zone, except for the small portion of sub-zone 204 occupied by the impingement cavity 152 and showerhead holes 156 and a small portion of sub-zone 206 in the vicinity of the serpentine leg 146*e*. However, the conduits may be distributed over less than the entire length of the high heat load zone. For example, auxiliary conduits may be distributed over substantially the entire length $L_S$ of the suction surface sub-zone 204, but may be absent in the pressure surface sub-zone 206. Conversely, conduits may be distributed over substantially the entire length $L_P$ of the pressure surface sub-zone 206 but may be absent in the suction surface sub-zone 204. Moreover, conduits may be distributed over only a portion of either or both of the subzones. The extent to which the conduits of the auxiliary cooling system are present or absent is governed by a number of factors including the local intensity of the heat load and the desirability of mitigating the rise of coolant temperature in one or more of the medial passages.

The airfoil may also include a set of radially distributed coolant replenishment passageways 222, each extending from an internal passage (e.g., passage 144, 146*a* and 148) to the auxiliary cooling system. Coolant from the medial passage flows through the passageways 222 to replenish coolant that is discharged from the conduits through the film cooling holes 196. The replenishment passageways are situated between along the airfoil spam S (i.e., the radial distance from the root to the tip) but may be distributed along substantially the entire span if necessary.

During engine operation, coolant flows into and through the internal passages and auxiliary conduits as described above to cool the blade peripheral wall 116. Because the conduits are situated exclusively within the high heat load zone, rather than being distributed indiscriminately around the entire periphery of the airfoil, the benefit of the conduits can be concentrated wherever the demand for aggressive heat transfer is the greatest. Discriminate distribution of the conduits also facilitates selective shielding of coolant in the medial passages, thereby preserving the coolant's heat absorption capacity for use in other parts of the cooling circuit. The small size of the conduits also permits the use of trip strips whose height, in proportion to the conduit lateral dimension, is sufficient to promote excellent heat transfer.

Figure 4:
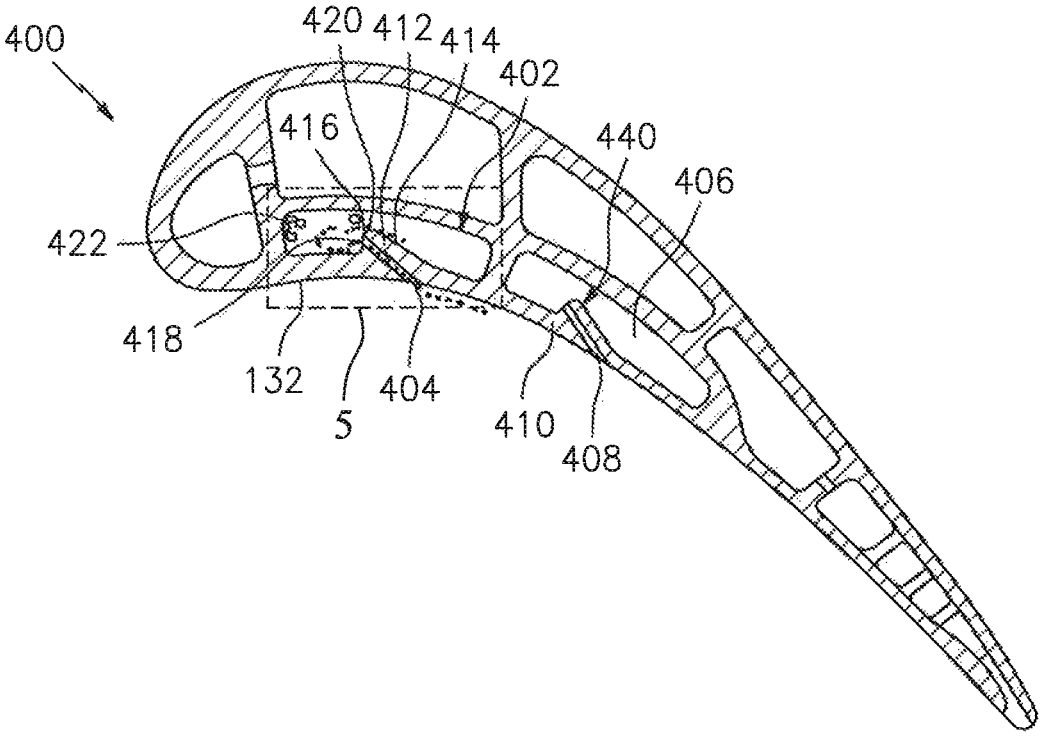
FIG. 4 is a cross sectional view of internally cooled airfoil with an internal dirt separator.

FIG. 4 is a cross sectional and view of an internally cooled airfoil 400 according to an aspect of the invention. One of ordinary skill in the art will appreciate that the view illustrated hi FIG. 4 is simplified in the interest of ease of illustration and that the airfoil includes numerous cooling holes other than those illustrated in the simplified exemplary embodiment illustrated in FIG. 4. In this embodiment, first cooling feed passage 402 includes a first cooling hole 404, and a second cooling feed passage 406 includes a second cooling hole 408. The first and second cooling holes 404, 408 exit the pressure surface side 132 of the airfoil 400. The first cooling teed passage 402 is partially formed by a pressure surface wall 410 that includes a thickened pressure surface wall section 412 through which the first cooling hole 404 passes from the passage 402 to pressure surface side 132. The thickened pressure surface wall section 412 may be an interior bulbous protrusion (e.g., an asymmetric rounded protrusion) that extends from an interior side of the passage 302 to the pressure surface side 132.

The interior protrusion 412 may include a first sloped surface 414 extending to a peak 416 of the protrusion 412 and a second sloped surface 418 extending from the peak 416 substantially back toward the pressure side surface 132. Slope of the second sloped surface 418 is greater than the slope of the first sloped surface 414. In this embodiment the first and second sloped surfaces 414, 418 intersect to form a rounded edge 420. The rounded edge may have a single radius or may be a compound curvature. The first cooling hole 404 extends through the second sloped surface 418 to vent the first internal cooling passage 402 to the pressure side surface 132. The interior protrusion 412 provides a dirt filtering system. Slope of the first sloped surface 414 and slope of the second sloped surface 418 are selected so dirt particles within the first internal passage 402 are routed away from the first cooling hole 404. Dirt and air traveling up the first cooling feed passage 402 travel along the first sloped surface 414. The shape of the interior protrusion 412 separates the dirt from and the vented air, with dirt gathering in a first portion 422 of the first cooling feed passage 402 away from the first cooling hole 404. Since the dirt is removed from the air that is to pass through the first cooling hole 404, this cooling hole can be smaller than the nominal minimum diameter for an airfoil cooling hole since risk of dirt reducing flow through the hole 404 is reduced.

FIG. 4 also illustrates a second protrusion 440 in the second cooling feed passage 404. The shape of the second protrusion 440 is substantially similar to the shape of the first protrusion 412 in order to separate dirt directly from the vented air in the second cooling feed passage.

Figure 5:
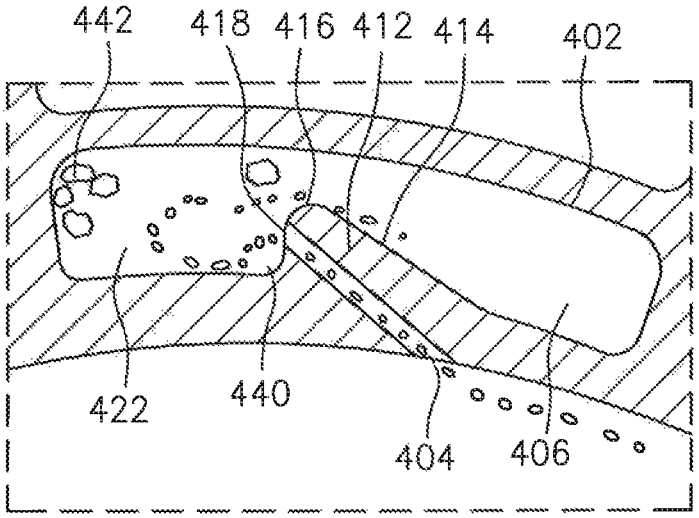
FIG. 5 is an exploded view of a portion of the internally cooled airfoil illustrated in FIG. 4.

FIG. 5 is an exploded view of a portion of the airfoil 400 in the area of the first cooling feed passage 402. In this exploded view dirt/debris 442 is illustrated in the first portion 422 of the first cooling feed passage 402 while clean air 444 (i.e., air with substantially all the dirt/debris) is located immediately adjacent to inlet to the second cooling feed passage.

Figure 6:
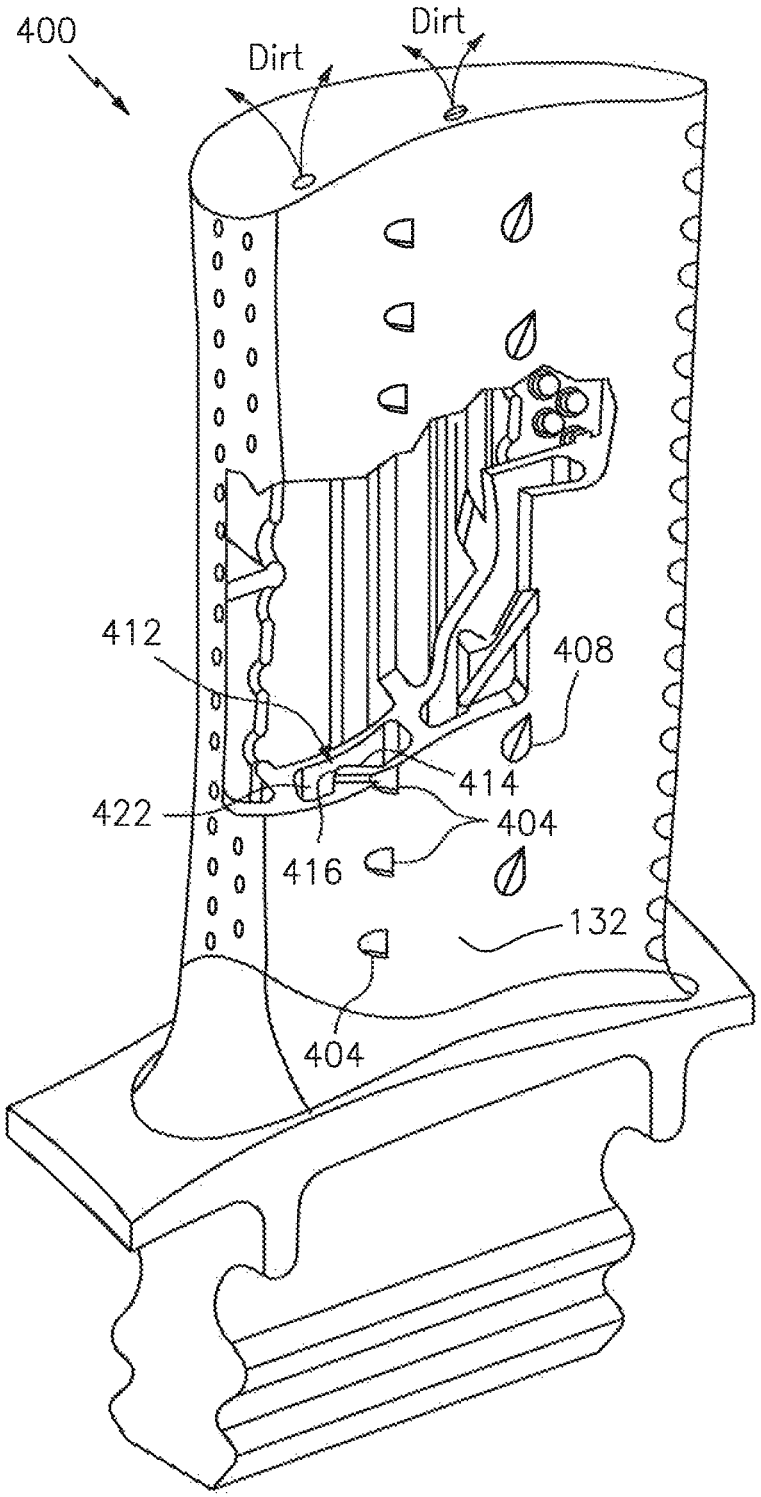
FIG. 6 is a perspective view, partially cut away, of the internally cooled airfoil illustrated in FIG. 4. As shown the cooling holes from the projection passage may be radially arranged.

FIG. 6 is a perspective view, partially cut away, of the internally cooled airfoil illustrated in FIG. 4. As shown the interior air/dirt separating protrusions 412 are radially distributed, includes a plurality of cooling holes 404 extending from the second sloped surface to the pressure side surface, and can be oriented radially, chordwisely, or a combination to maximize dirt separation depending on the local internal flow direction.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments. For example, it is contemplated that the dirt separator for internally cooled components disclosed herein it not limited to use in vanes and blades, but rather may also be used in combustor components or anywhere there may be dirt within an internal flowing passage.

It should be understood that like reference numerals identify corresponding or similar elements throughout the several drawings. It should also be understood that although a particular component arrangement is disclosed in the illustrated embodiment, other arrangements will benefit herefrom.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A gas turbine engine internally cooled component airfoil, comprising:

a peripheral wall having an external surface comprising a suction surface and a pressure surface laterally spaced from the suction surface, the surfaces extending chordwisely from a leading edge to a trailing edge and radially from a proximate end to a distal end; and a cooling system comprising at least one or more passages bounded in part by the peripheral wall, where at least a first of the one or more passages includes a first passage pressure side surface that includes an interior protrusion comprising a first sloped surface extending to a peak of the interior protrusion and a second sloped surface extending from the peak substantially in the direction of the pressure side surface, where the slope of the second sloped surface is greater than the slope of the first sloped surface and a first cooling hole extends from the second sloped surface through the interior protrusion to vent the first of the one or more passages to the pressure side surface;

where the first and second sloped surfaces intersect to form a rounded edge; and where the slope of the first sloped surface and the slope of the second sloped surface are selected to dirt particles within the first passage are routed away from the first cooling hole.

2. The gas turbine engine internally cooled component of claim 1 further comprising a debris passage in a radial tip of the internally cooled airfoil and in fluid communication with the first passage to allow debris to pass from the first passage through the debris passage.

3. The gas turbine engine internally cooled component of claim 1, where the first cooling hole has a circular cross section, the proximate end is adjacent to an airfoil root and the distal end is adjacent to an airfoil tip.

4. The gas turbine engine internally cooled component of claim 3, where the interior protrusion has substantially a bulbous shape.

5. The gas turbine engine internally cooled component of claim 3, where the first passage and a second passage of the one or more passages are chordwisely adjacent and radially extending.

6. The gas turbine engine internally cooled component of claim 5, where the first and second passages are interconnected to form a cooling serpentine.

7. A gas turbine engine internally cooled airfoil, comprising:

a peripheral wall having an external surface comprising a suction surface and a pressure surface laterally spaced from the suction surface, the surfaces extending chordwisely from a leading edge to a trailing edge and radially from an airfoil root to an airfoil tip;

a cooling system comprising at least two passages bounded in part by the peripheral wall, chordwisely adjacent and radially extending from the airfoil root to the airfoil tip, where each of the at least two passages includes a passage pressure side surface that includes an interior air/dirt separating protrusion comprising a first sloped surface extending to a peak of the interior air/dirt separating protrusion and a second sloped surface extending from the peak substantially in the direction of the pressure side surface, where the slope of the second sloped surface is greater than the slope of the first sloped surface and a first cooling hole extends from the second sloped surface through the air/dirt separating interior protrusion to vent the respective first or second passage to the pressure side surface; and an airfoil tip surface that substantially seals each of the least two passages at a tip region of the airfoil, where the airfoil tip surface comprises a radially extending debris hole that allows debris particles to exit the airfoil from each of the at least two passages;

where the first and second sloped surfaces intersect to form a rounded edge and slope of the first sloped surface and slope of the second sloped surface are selected so dirt particles within the first passage are routed away from the first cooling hole.

8. The internally cooled airfoil of claim 7, where the first cooling hole has a circular cross section and the radially extending debris hole also has a circular cross section.

9. The internally cooled airfoil of claim 8, where the interior protrusion has substantially a bulbous shape.

10. The internally cooled airfoil of claim 8, where the first and second passages are interconnected to form a cooling serpentine.

11. A gas turbine engine internally cooled component, comprising:

a peripheral wall having an external surface comprising a suction surface and a pressure surface laterally spaced from the suction surface, the surfaces extending chordwisely from a leading edge to a trailing edge and radially from an airfoil root to an airfoil tip; and a cooling system comprising at least two passages bounded in part by the peripheral wall, where at least a first of the at least two passages includes a first passage pressure side surface that includes an interior protrusion comprising a first sloped surface extending to a peak of the interior protrusion and a second sloped surface extending from the peak substantially in the direction of the pressure side surface, where the slope of the second sloped surface is greater than the slope of the first sloped surface and a first cooling hole extends from the second sloped surface through the interior protrusion to vent the first of the at least two passages to the pressure side surface;

where the first and second sloped surfaces intersect to form a rounded edge, and slope of the first sloped surface and slope of the second sloped surface are selected so dirt particles within the first passage are routed away from the first cooling hole.

12. The gas turbine engine internally cooled component of claim 11 further comprising a debris passage in a radial tip of the internally cooled component and in fluid communication with the first passage to allow debris to pass from the first passage through the debris passage.

13. The gas turbine engine internally cooled component of claim 12, where the first cooling hole has a circular cross section.

14. The gas turbine engine internally cooled component of claim 13, where the interior protrusion has substantially a bulbous shape.

15. The gas turbine engine internally cooled component of claim 14, where the at least two passages are chordwisely adjacent and radially extending.

16. The gas turbine engine internally cooled component of claim 15, where the at least two passages are interconnected to form a cooling serpentine.

* * * * *